US006651828B2

(12) United States Patent
Dimattio et al.

(10) Patent No.: US 6,651,828 B2
(45) Date of Patent: Nov. 25, 2003

(54) DISPLAY APPARATUS WITH INTEGRATED DIVIDERS

(75) Inventors: Thelma M. Dimattio, Wilton, CT (US); Debra Moreira-Caunedo, Poughkeepsie, NY (US); Howard Lowenbraun, New York, NY (US)

(73) Assignee: U.S. Smokeless Tobacco Brands Inc., Greenwhich, CT (US)

( * ) Notice: Subject to any disclaimer, the term of this patent is extended or adjusted under 35 U.S.C. 154(b) by 0 days.

(21) Appl. No.: 09/972,778

(22) Filed: Oct. 5, 2001

(65) Prior Publication Data

US 2003/0066811 A1 Apr. 10, 2003

(51) Int. Cl.[7] ..... A47F 5/00

(52) U.S. Cl. ..... 211/59.2; 211/184; 211/59.4; 211/175; 211/169; 108/60

(58) Field of Search ..... 211/43, 90.01, 211/90.02, 184, 59.2, 59.4, 175, 169, 169.1, 41.5, 41.6, 195, 149, 85, 132.1, 126.6; 108/60; 312/42, 45, 35, 71, 72

(56) References Cited

U.S. PATENT DOCUMENTS

| | | | | | |
|---|---|---|---|---|---|
| 2,309,896 | A | * | 2/1943 | Gustafson et al. | 211/184 |
| 2,658,628 | A | | 11/1953 | Hilgen | |
| 3,117,535 | A | | 1/1964 | Hendrickson | |
| 3,124,254 | A | * | 3/1964 | Davidson | 211/184 |
| 3,127,022 | A | * | 3/1964 | French | 211/184 |
| 3,433,364 | A | | 3/1969 | Chen | |
| 3,612,288 | A | * | 10/1971 | Lesley | 211/132 |
| 3,893,739 | A | | 7/1975 | Bernard | |
| 4,169,638 | A | * | 10/1979 | Cirasuolo et al. | 211/41.6 |
| 4,646,922 | A | * | 3/1987 | Smith | 211/132.1 |
| 4,768,659 | A | | 9/1988 | Merl | |
| 4,772,077 | A | * | 9/1988 | Beam et al. | 206/387.15 |
| 5,217,121 | A | * | 6/1993 | Walker | 211/41.1 |
| 5,228,578 | A | * | 7/1993 | Wu | 211/175 |
| 5,341,945 | A | * | 8/1994 | Gibson | 108/60 |
| 5,450,968 | A | | 9/1995 | Bustos | |
| 5,765,390 | A | * | 6/1998 | Johnson et al. | 211/43 |
| 6,170,676 | B1 | * | 1/2001 | Patadia et al. | 211/41.3 |
| 6,273,006 | B1 | * | 8/2001 | Reutter et al. | 108/53.1 |
| 2001/0020606 | A1 | * | 9/2001 | Battaglia et al. | 211/59.2 |

* cited by examiner

*Primary Examiner*—Bruce A. Lev
*Assistant Examiner*—Jennifer E. Novosad
(74) *Attorney, Agent, or Firm*—Kramer Levin Naftalis & Frankel LLP

(57) ABSTRACT

A merchandise display shelf comprising a display surface with integral divider assemblies, each such assembly including a folding partition, the divider assemblies being movable between a closed position wherein the partitions occupy recesses in the surface, and an upright position, such that display channels formed between folding partitions can be variably sized to accommodate a variety of merchandise on the display surface.

15 Claims, 6 Drawing Sheets

FIG. 2
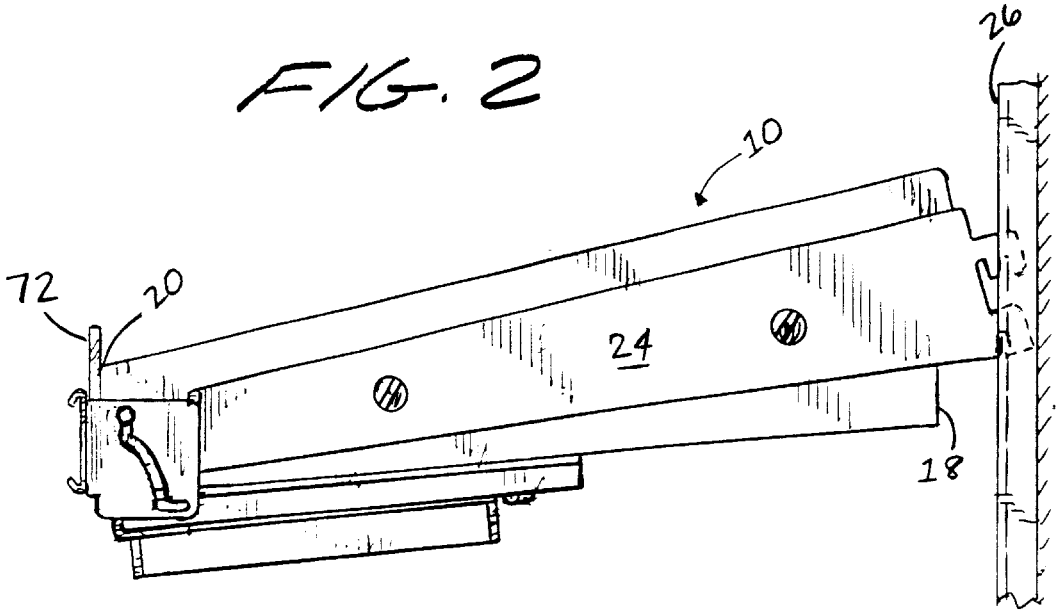
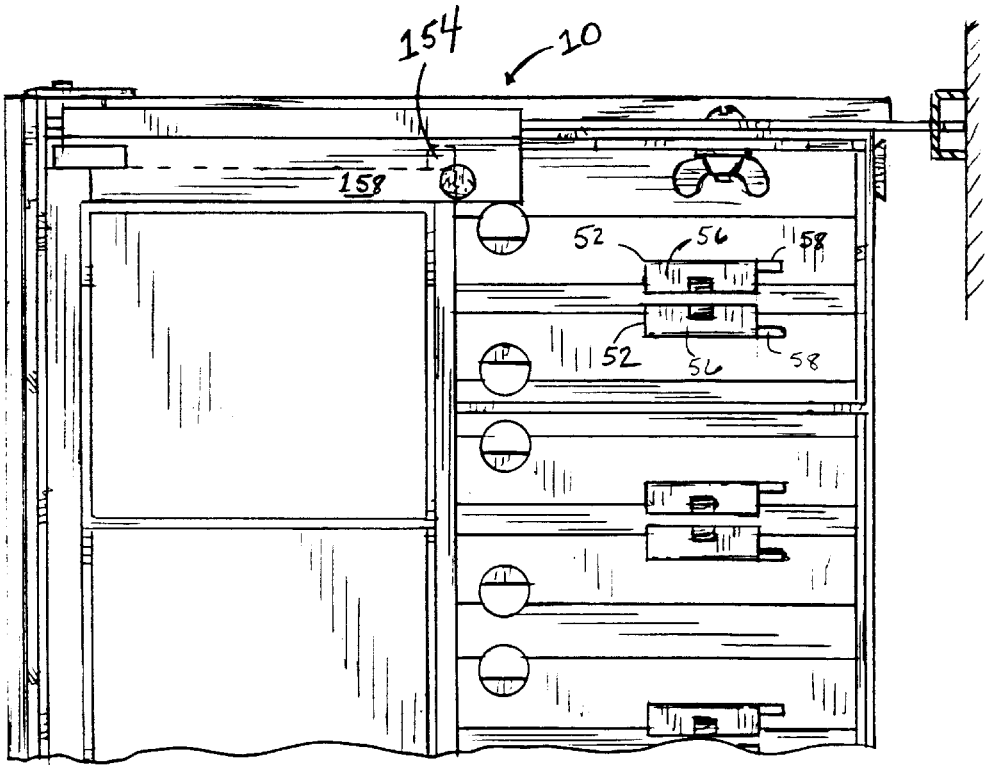
FIG. 3

FIG. 4
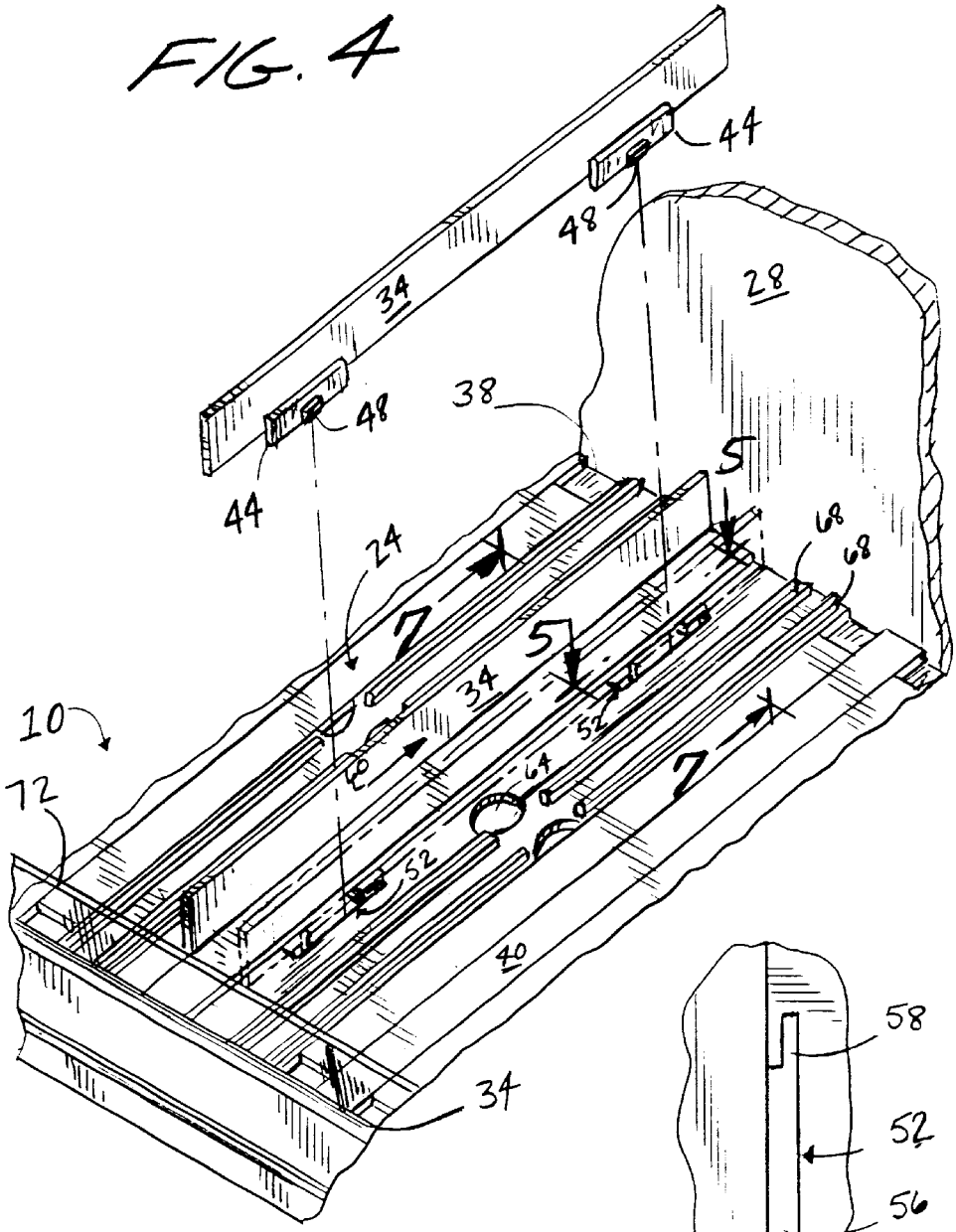
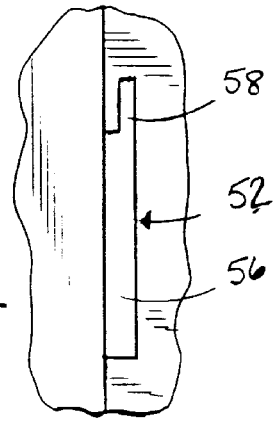
FIG. 5

FIG. 8
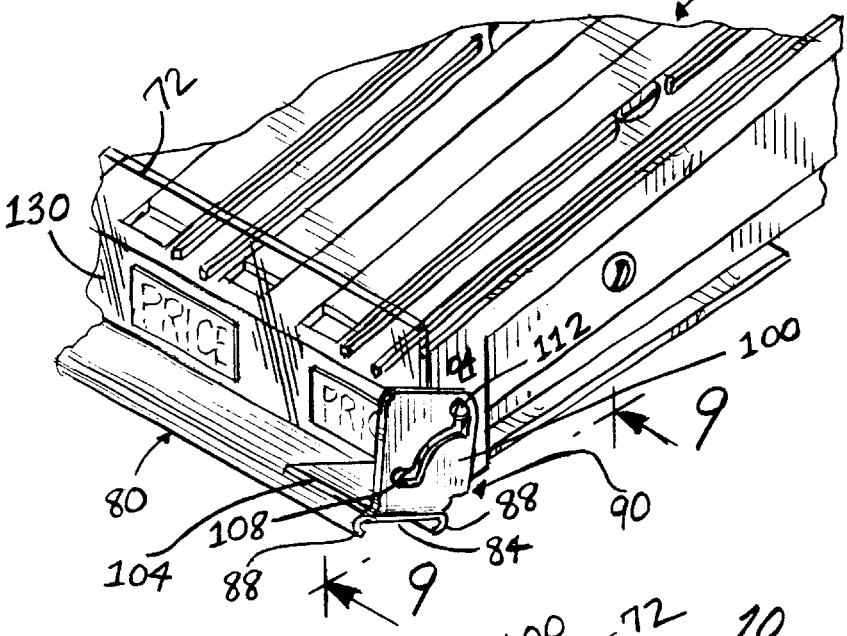
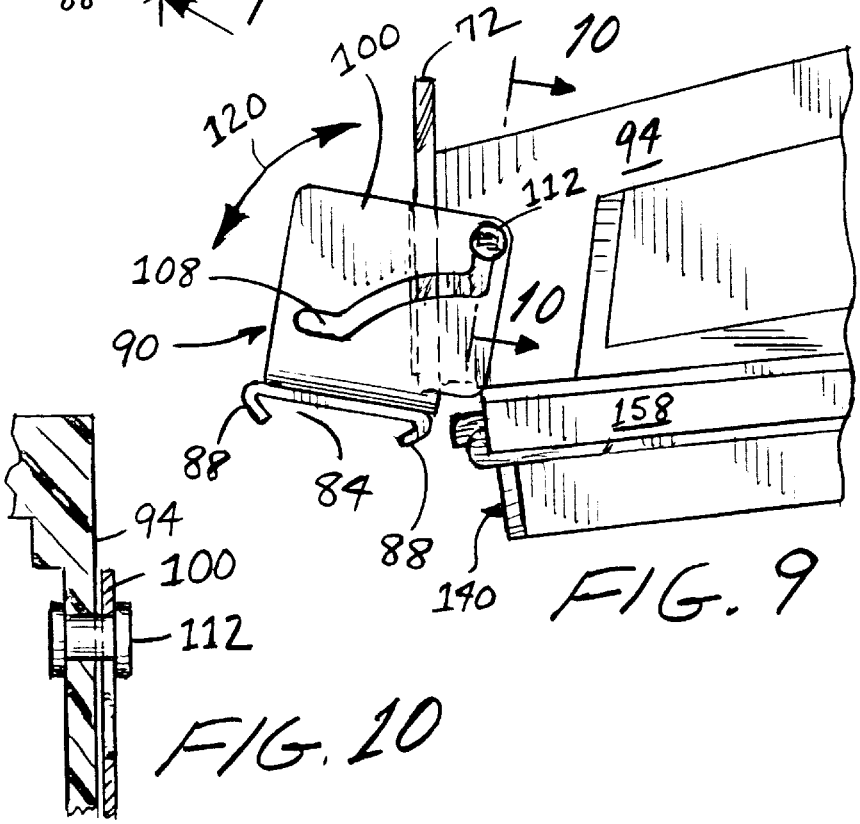
FIG. 9
FIG. 10

DISPLAY APPARATUS WITH INTEGRATED DIVIDERS

FIELD OF THE INVENTION

The present invention is generally directed to a merchandise display apparatus and preferably a so-called gravity-feed display apparatus, including integrated divider assemblies for displaying and holding merchandise in a stacked, front-facing formation for enhanced merchandise visibility and consumer access.

BACKGROUND OF THE INVENTION

Various shelf and display unit designs are known for holding merchandise and displaying it to consumers. Display units and shelves typically have two main design objectives: (i) to display the merchandise in a clear and conspicuous manner, and (ii) to permit easy access to the merchandise by consumers. How this is accomplished often depends on the dimensions and type of merchandise.

In the supermarket or grocery store, for example, most items, except perishable items, are displayed on flat shelves that line the aisles of the supermarket or grocery store. The merchandise is often arranged on the shelves from front to back for easy viewing and access by the consuming public. As the merchandise in the front is purchased, it becomes necessary for supermarket employees to bring the merchandise manually from the back of the shelf toward the front of the shelf to keep the merchandise in a conspicuous position. This is a labor intensive exercise, and susceptible of sloppy or untimely execution.

To address such shortcomings, some shelves have been configured with a sloping display surface such that as an item of merchandise is removed from the front of the shelf the items located in the rear slide forward under the influence of gravity, i.e., so-called gravity-feed shelves. Gravity-feed shelves are an improvement over conventional display shelves in that less labor is required to maintain the merchandise proximate the front of the shelf where it is easily viewed and accessed by consumers. However, these shelves may not be useful for all types of merchandise.

An adaptation of this type of specialty shelf is used for displaying smokeless tobacco. That product is often sold in canisters which are loaded in specially designed, gravity-feed type displays that automatically feed the canisters toward the front of the display. The smokeless tobacco displays include a track that holds and displays the canisters in a single file. Like with other gravity-feed displays or shelves, as the canisters toward the front of the display are removed after purchase other canisters from further back on the display are fed under the influence of gravity toward the front. However, these displays work only with smokeless tobacco canisters of standard size and typically cannot accommodate any other products.

While many designs are available, there is still need for a display that may be conveniently loaded and easily customized to accommodate merchandise of varying dimension or scale, while nonetheless affording the product visibility and accessibility which is desired. There is especially a need for gravity-feed display apparatus in which configuration-adjustability is easy and convenient.

SUMMARY OF THE INVENTION

It is an object of the present invention to address and overcome the deficiencies of the prior art by providing apparatus that can be configured to display and hold merchandise items of varying size in and, at the same time, afford product visibility and accessibility, and further providing advantageous methods of displaying such merchandise.

It is still another object of the invention to provide a display apparatus and methods involving utilization of integrated divider assemblies, each for displaying merchandise in a stacked, forward-facing formation.

It is still another object of the present invention to provide apparatus and methods involving utilization of a display channel to permit the arrangement and display of variously sized merchandise in a stacked, forward-facing formation within such display channels, thereby enhancing merchandise visibility and accessibility.

Accordingly in one aspect the invention is in a display apparatus, which comprises a shelf element, a plurality of partitions pivotally mounted to the shelf element for movement between a closed position and a substantially upright position, said shelf element having recesses formed therein adapted to receive the partitions in their closed position, at least a pair of the partitions being oriented such that in their upright position they define a channel for holding an item of merchandise between them. Thus, the apparatus includes a plurality of integrated divider assemblies for defining one or more display channels that hold an item or items of merchandise such as canisters of smokeless tobacco in a stacked, forward facing formation. (As discussed hereinafter, typically, though not necessarily, each divider assembly comprises an elongated rectangular partition that extends substantially between a first edge and a second edge of a display surface of the shelf.) An equal number of recesses is also provided in the shelf element for holding the partitions in their closed positions.

In another aspect the invention is in a method of displaying an item of merchandise, which comprises supporting a pair of partitions on a shelf element such that they are capable of pivoting between a closed position in which each of the partitions lies in a recess in the shelf element, and a substantially upright position in which the partitions are arranged to define a channel between them, and holding said item of merchandise in said channel with said partitions in the upright position.

In a further aspect the invention is in a method of displaying an item of merchandise, which comprises loading said item of merchandise into a channel formed between a pair of partitions which are pivotally mounted on a shelf element, the partitions being movable between a closed position in which each of the partitions lies in a recess in the shelf element and an upright position in which the partitions are arranged to define said channel.

Substantial advantages accrue with practice of the invention. More specifically, the fundamental benefits of apparatus enabling stacked, forward-facing display of merchandise can still be secured, while also enjoying greater versatility and convenience. Thus, successful display formats with which the purchasing public is familiar can be retained. Furthermore, the invention permits a convenience in loading which makes it attractive in the retail environment. And, the invention is not exclusively adapted for use with smokeless tobacco canisters, but instead has utility for other products as well. Indeed, in certain embodiments, the spacing between partitions can be varied to change the size of the channel they form in order to accommodate different sized products.

Additional objects, features and advantages of the invention appear from the following detailed disclosure.

BRIEF DESCRIPTION OF THE DRAWINGS

The aforementioned and other objects, features and advantages of the present invention appear from the detailed description thereof which is to be read in connection with the accompanying drawings, in which:

FIG. 2 is a side elevational view of the display apparatus section as aforesaid showing in phantom detail the connection of the shelf to the support rail of a display;

FIG. 3 is a bottom plan view of the display apparatus section as aforesaid;

FIG. 4 is a partially-exploded view of the display apparatus section shown in FIG. 1;

FIG. 5 is a view taken along the line 5—5 of FIG. 4;

FIG. 8 is a front-perspective view of a portion of the display apparatus section of FIG. 1 showing a first advertising panel in an open position;

FIG. 9 is a view taken along the line 9—9 of FIG. 8;

FIG. 10 is a view taken along the line 10—10 of FIG. 9;

Like reference numerals refer to corresponding parts throughout the drawings.

DESCRIPTION OF CERTAIN PREFERRED EMBODIMENTS

Figure 1:
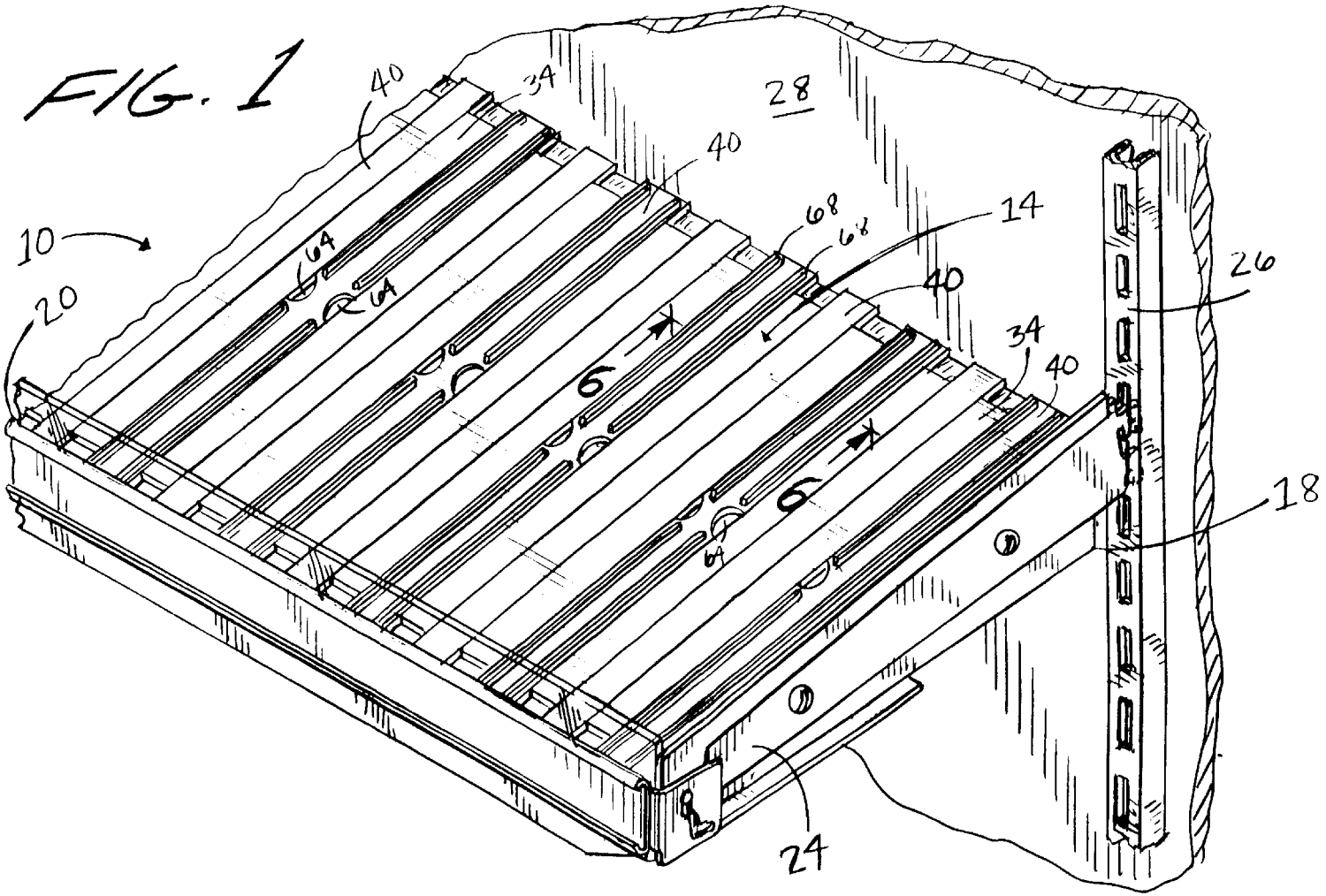
FIG. 1 is a perspective view of a section of a display apparatus connected to a support rail including a plurality of divider assemblies according to a preferred embodiment of the present invention.

A central focus of the present invention is the utilization of adjustable partitions in conjunction with a gravity-feed shelf to secure the benefits discussed heretofore. By use of such shelf, stock is automatically urged toward the front of the shelf, into an area of high visibility. This occurs in "real time" rather than when store personnel can find the time. Product exposure is maximized. Each partition advantageously is a divider assembly comprising a pivotally foldable partition mounted to move between a closed position and an open position. Partitions cooperate to define display channels.

In a further aspect of the present invention, the partitions include laterally-spaced hinge elements for pivotally mounting the partitions for operation in conjunction with the display surface of the shelf element. In particular, the recesses are provided with cut-outs or slots that receive the hinge elements. The slots are configured to allow the partitions to swing or pivot between the open or upright position and the closed position.

As will be set forth with greater specificity hereinafter, the plurality of divider assemblies can be variably configured to accommodate a variety of merchandise on a display surface of the shelf element. More particularly, when the divider assemblies of the stated type are in the closed position, i.e., received within recesses in a display surface of the shelf element, a substantially flat or planar display surface is provided for holding and displaying merchandise. When at least a pair of divider assemblies is in the open or upright position, a display channel is provided on the display surface of the shelf. The width of the display channel depends on which two divider assemblies have been opened. For example, opening two adjacent divider assemblies will provide a narrow display channel, while opening two divider assemblies spaced at a greater distance will provide a wider display channel capable of holding and displaying a larger item of merchandise.

In other good embodiments of the present invention, the shelf element may be equipped with one or more advertising panels for promoting the sale of the merchandise being displayed.

Referring to the drawing, and in particular to FIGS. 1 through 5, a display apparatus 10 is shown according to a preferred embodiment of the present invention. The apparatus 10 of the present invention preferably comprises a so-called gravity-feed shelf having a display surface 14 that slopes downwardly from a second (or rear) edge 18 of the display shelf 10 toward a first (or front) edge 20 thereof. Mounting brackets 24 are provided for fastening the apparatus 10 to a support rail 26 of a display unit 28 as is generally known to those skilled in the art.

The apparatus 10 further includes a plurality of divider assemblies 30, as best shown in FIGS. 4 through 7. Each divider assembly 30 comprises an elongated, generally rectangular-shaped partition 34, which is mounted within apparatus 10 to move between and open (upright) position and a closed (flat) position. In the closed position, the partition, which extends substantially between the front edge 20 and rear edge 18 of the display shelf 10, is received within a similarly dimensioned recess 38.

More particularly, a display surface 14 of apparatus 10 includes a plurality of recesses 38, one recess 38 per partition 34. In a preferred embodiment, the display surface 14 is configured to have an alternating pattern of elevations or landings 40 and recesses 38, as shown in detail in FIGS. 6 and 7. Depending on the material that is utilized to form the shelf, such an alternating pattern may be formed using any number of known manufacturing techniques. For example, in the case of a plastic or a fiber-glass shelf, the shelf may be molded or cast to have the alternating pattern of recesses 38 and landings 40. Obviously, other manufacturing techniques would be employed for shelves made from other materials such as metal.

The display apparatus 10, as described, gives a retailer the flexibility to display many types of merchandise while maintaining good merchandise visibility and consumer accessibility. As shown in FIG. 1, when all the divider assemblies 30 are in the closed positions (i.e., the partitions 34 are within recesses 38), the display surface 14 defines a substantially planar area that may be used to display any type of merchandise, large or small. Alternatively, when at least two partitions 34 are both in the upright position, a display channel is formed between which appropriately sized merchandise may be stacked in a forward-facing formation.

By providing an alternating pattern of recesses 38 and landings 40, as previously described, display channels of various widths can be easily configured. Obviously, depending on the lateral spacing between the partitions 34 selected to form the display channel, merchandise of varying size can be displayed so as to take advantage of the benefits of the shelf of the present invention. Preferably, at least one elevation or landing 40 will run within the display channel for supporting the stacked merchandise.

In the preferred embodiment, all divider assemblies 30 are similarly sized with the partition 34 being slightly smaller in length than the recess 38, as shown for example in FIG. 1. The smaller length of the partition 34 allows the partition 34 to be locked in the upright position, as described in greater detail below. However, in other embodiments partitions 34 and recesses 38 can be of varying size without deviating from the objects or benefits of the present invention.

Referring now to FIGS. 4 through 7, details of the divider assemblies 30 according to a preferred embodiment of the present invention will be provided with reference to a single divider assembly 30. The partition 34 includes laterally spaced hinge elements 44, which include locking wedges 48 for pivotally affixing the partition 34 in the display apparatus 10 within recess 38. The recess 38 includes laterally spaced slots 52 for receiving the hinge elements 44 and locking wedges 48. The slots 52 are located adjacent the rear and front edges 18, 20 and comprise a first rectangular-shaped opening 56 that extends contiguously with or into a second, narrower, rectangular-shaped opening 58.

To fasten the partition 34 to apparatus 10, the hinge elements 44 are inserted within first openings 56 of slots 52 and maintained therein by locking wedges 48. When installed within the slots 52, partitions 34 can freely pivot within first openings 56 (about hinge elements 44) between an upright position and the closed position, as shown in FIG. 4. In the upright position, partition 34 is oriented substantially perpendicularly to display surface 14. Partition 34 is maintained in the upright position by sliding it in the direction of arrow 60 (FIG. 4). This sliding action causes hinge elements 44 to engage second openings 58 of slots 52 to lock the partition 34 in the upright position. To move the partition 34 into the closed position, the partition 34 is slid in the direction opposite arrow 60 until hinge elements 44 are again free to pivot within first openings 56. Once in this position, the partition 34 can be folded into the closed position.

Figure 7:
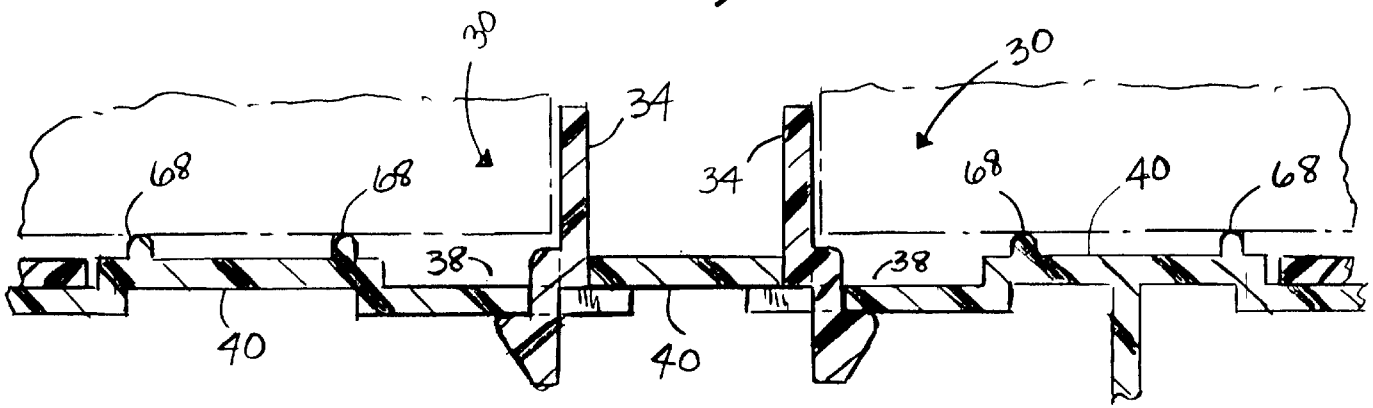
FIG. 7 is a view taken along the line 7—7 of FIG. 4.

As shown in FIGS. 4 and 7, in a preferred configuration, a pair of divider assemblies 30 is pivotally mounted to the shelf 10 around a single landing 40. In the preferred embodiment, one partition 34 is mounted to pivot in the clockwise direction about a landing 40, while a second partition 34 is mounted to pivot counter-clockwise about the same landing 40.

Figure 6:
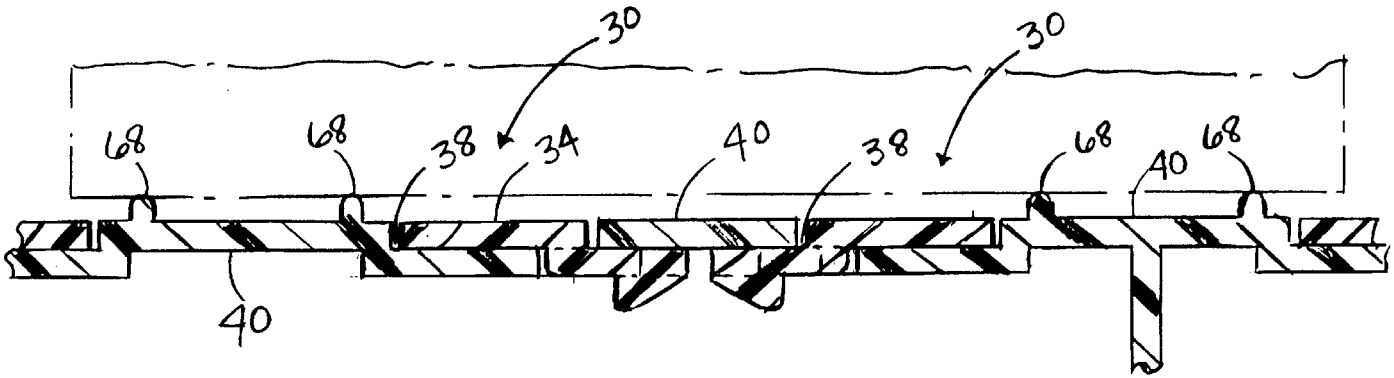
FIG. 6 is a view taken along the line 6—6 of FIG. 1.

Referring to FIGS. 5 through 7, display surface 14 may also include finger-engagement notches 64 to facilitate pivoting partitions 34 into the open or upright positions. Notches 64 are embodied partly within landings 40 and extend into the recesses 38. Moreover, in a so-called gravity-feed shelf, the landings 40 can also include low-friction glides 68 to minimize friction as merchandise slides from the rear of the shelf toward the front of the shelf under the influence of gravity. A transparent plexi-glass partition may 72 also be positioned along front edge 20 to prevent items from falling off when the items slide forward under the influence of gravity.

Referring now to FIGS. 8 through 13, other aspects of the preferred embodiment of the present invention are shown. In particular, FIGS. 8 through 10 illustrate in more detail display apparatus 10 including a first advertising panel 80. The advertising panel 80 is comprised of a display channel 84 formed between ledges 88 for holding and displaying printed advertising material (not shown).

The advertising panel 80 is mounted with brackets 90. Only one bracket 90 is shown in the drawings, the other side being identical. Each bracket 90 is pivotally mounted to a side-wall 94 of apparatus 10. The brackets 120 each comprise a shelf mounting portion 100 and a display panel-mounting portion 104, extending from each other at approximately a right angle. The shelf-mounting portion includes a groove 108 that forms a guide channel for pivoting bracket 90 about a rivet or other pivot means 112 in the directions indicated by arrow 120. The display panel mounting portion 104 is secured to a rear side of the advertising panel 80 using glue, rivets, welding or other well known fastening means and techniques.

Figure 11:
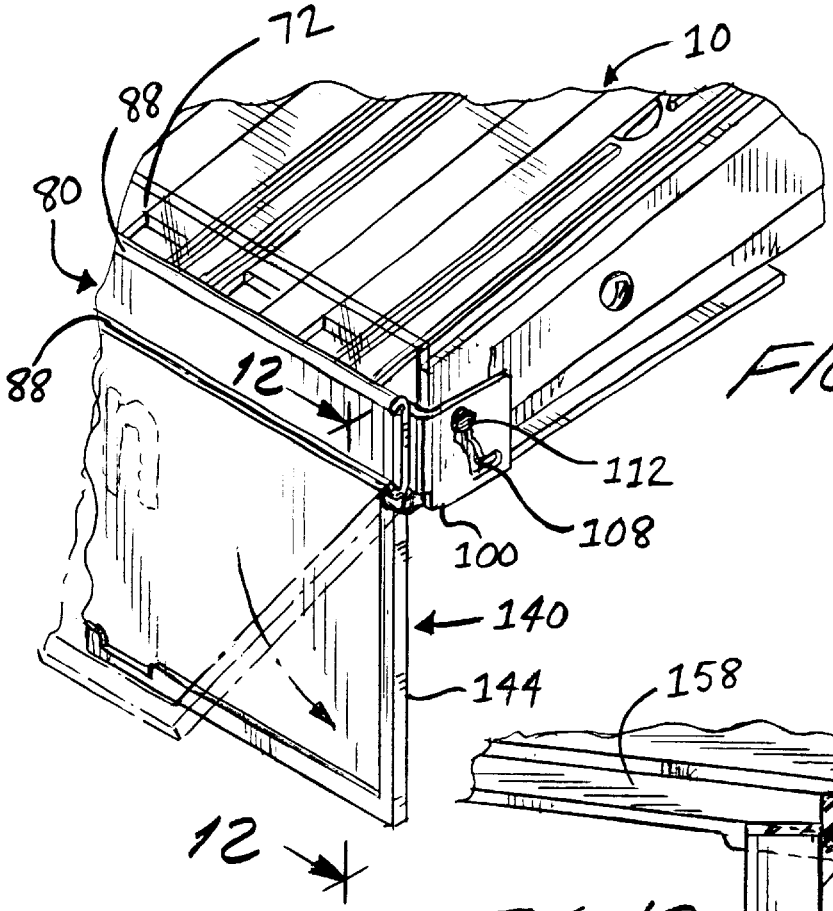
FIG. 11 is a front-perspective view of a portion of the display apparatus section of FIG. 1 showing a second advertising panel in greater detail.

Advertising panel 80 can be pivoted to an open position, as shown in FIGS. 8 and 9 or a closed position, as shown in FIGS. 1 and 11. In the open position, advertising panel 80 is pivoted to expose front panel 130, which may include additional advertising or pricing information. In the upright position, advertising panel 80 is positioned over front panel 130 concealing any printed information.

Figure 12:
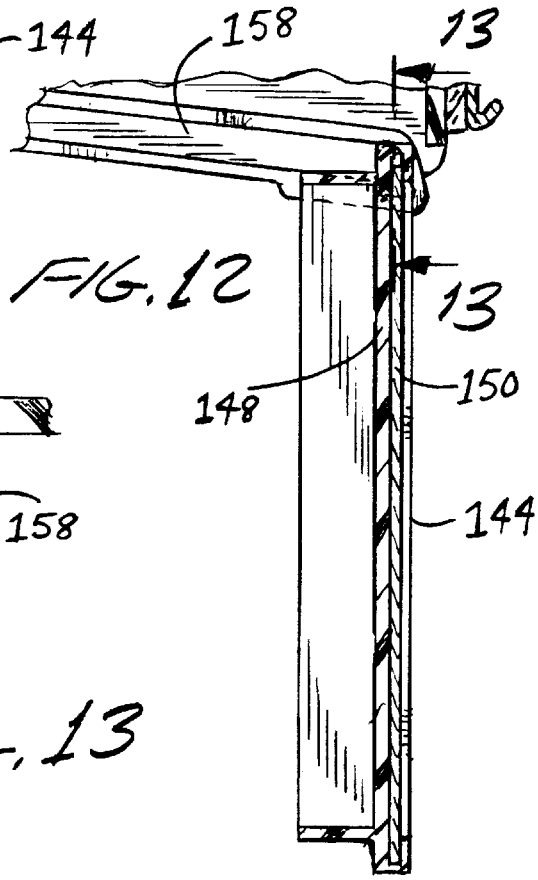
FIG. 12 is a view taken along line 12—12 of FIG. 11.
Figure 13:
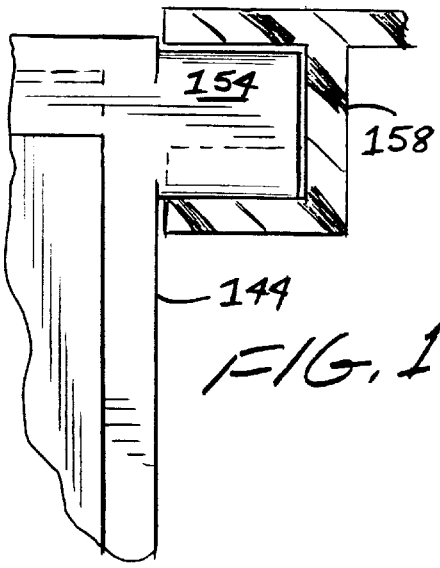
FIG. 13 is a view taken along line 13—13 of FIG. 12.

Referring now to FIGS. 11 through 13, other aspects of the present invention are illustrated in more detail. As shown, display apparatus 10 can be equipped a second or drop-down advertising panel 140 that includes a generally rectangular-shaped support frame 144 and a center display panel 148 for holding advertising material and/or pricing information 150.

Panel 140 is suspended from just below front panel 130 when in use and is stored along the underside of apparatus 10 when not in use, as shown in FIG. 3. More particularly, support frame 144 includes tabs 154 for guiding panel 140 between an open position and a closed position. In the open position, tabs 154 are used to suspend panel 140 from a leading edge of generally u-shaped tracks 158. In the closed position, panel 140 is supported within tracks 158.

It will thus be seen that the objects of the present invention are efficiently attained. Since certain changes may be made in practicing the apparatus and above method embodiments of the present invention without departing from the spirit and scope of the invention, it is intended that all matter contained in the above description and shown in the accompanying drawings shall be interpreted as illustrative and not in a limiting sense.

What is claimed is:

1. A display shelf comprising:

a display surface having a front end and a rear end;

partitions extending between the front end and the rear end of the display surface, each of the partitions including pivot means for pivotally mounting the partitions to the display shelf thereby allowing movement between a substantially upright position and a closed position, wherein at least a pair of the partitions when in the upright position define a channel for displaying and holding between the pair of partitions an item of merchandise, said pivot means including laterally spaced hinge elements; and recesses formed within the display surface adapted to receive the partitions in their closed positions, said recesses further comprising slots adapted to receive the hinge elements to pivotally mount the partitions to the shelf.

2. The display shelf of claim 1 wherein the display surface slopes downwardly from the rear end toward the front end.

3. The display shelf of claim 1 further comprising an advertising panel pivotally mounted to a front end thereof.

4. A display shelf comprising:

a display surface having a front end and a rear end;

partitions extending between the front end and the rear end of the display surface, each of the partitions including pivot means for pivotally mounting the partitions to the display shelf thereby allowing movement between a substantially upright position and a closed position, wherein at least a pair of the partitions when in the upright position define a channel for displaying and holding between the pair of partitions an item of merchandise; and recesses formed in the display surface adapted to receive the partitions in their closed positions and thereby define in the display surface an alternating pattern of recesses and elevations wherein each elevation includes a notch for facilitating the pivoting of one of the partitions into the upright position.

5. A display shelf comprising:

a display surface having a front end and a rear end;

a plurality of divider assemblies integrated within the display surface of the shelf, each divider assembly of the plurality of divider assemblies including a partition pivotally mounted to the shelf which moves between an upright position and a closed position and a recess adapted to receive the partition in the closed position, wherein at least a pair of the partitions when in the upright position define a channel for holding and displaying an item of merchandise, wherein the recesses are formed in the display surface of the shelf to define an alternating pattern of recesses and elevations, and wherein each of the elevations includes a notch for facilitating the pivoting of one of the partitions into the upright position.

6. The display shelf of claim 5 wherein each of the plurality of partitions extends substantially between the front end and the rear end of the display surface.

7. The display shelf of claim 5 wherein the display surface slopes downwardly from the rear end towards the front end.

8. The display shelf of claim 5 wherein each partition includes hinges for pivotally mounting the partitions to the display surface of the shelf.

9. The display shelf of claim 5 wherein the recesses further comprise slots disposed through each of the recesses and adapted to receive the hinges for pivotally mounting the partitions to the display surface of the shelf.

10. The display shelf of claim 9 wherein the slots are each comprised of a first opening and a second opening and wherein the second opening is smaller than the first opening in order to maintain each partition in the upright position.

11. A display shelf comprising:

a display surface having a front display end and a rear display end;

a plurality of partitions extending between the front display end and the rear display end; each of the plurality of partitions including a hinge element for pivotally mounting the partition to the shelf to allow movement of each of the plurality of partitions between an upright position and a closed position wherein at least a pair of the plurality of partitions when in the upright position define a channel for displaying and holding an item of merchandise; and a plurality of recesses, each recess of the plurality of recesses dimensioned to receive one partition of the plurality of partitions when in the closed position, wherein the hinge element comprises a pair of laterally spaced abutments located along an edge of the partition and each recess further comprises a pair of similarly, laterally spaced slots disposed through the recess and each slot of the pair of slots is adapted to receive one abutment of the pair of abutments for pivotally mounting one partition of the plurality of partitions to the display surface of the shelf.

12. The display shelf of claim 11 wherein each of the slots is comprised of a first opening and a second opening and wherein the second opening is smaller than the first opening in order to engage one of the abutments of the pair of abutments to maintain the one partition in the upright position.

13. A display shelf comprising:

a display surface having a front display end and a rear display end, the display surface configured to have an alternating pattern of recesses and landings;

a plurality of partitions extending between the front display end and the rear display end, each of the plurality of partitions including a pair of hinge elements for pivotally attaching each of the plurality of partitions to a pair of corresponding openings provided in each of the recesses to allow movement of each partition between a first position wherein the partition is substantially perpendicular to the display surface and a closed position wherein the partition is substantially parallel to the display surface and received within one of the plurality of recesses such that when all the plurality of partitions are in the closed position the display surface defines a generally planar surface and when two partitions of the plurality of partitions are in the upright position a display channel is formed for displaying and holding an item of merchandise.

14. The display shelf of claim 13 wherein each of the pair of hinge elements includes a locking wedge for securing the pair of hinge elements with the corresponding pair of openings.

15. The display shelf of claim 13 wherein each of the pair of openings is comprised of a first opening and a second opening and wherein the second opening is smaller than the first opening in order to engage and maintain one of the plurality of partitions in the upright position.

* * * * *